US008231214B2

(12) United States Patent
Roof et al.

(10) Patent No.: US 8,231,214 B2
(45) Date of Patent: Jul. 31, 2012

(54) METHOD AND APPARATUS FOR FIXING A RADIATION-CURABLE GEL-INK IMAGE ON A SUBSTRATE

(75) Inventors: Bryan J Roof, Newark, NY (US); Steven E Ready, Los Altos, CA (US); Jurgen H Daniel, San Francisco, CA (US)

(73) Assignee: Xerox Corporation, Norwalk, CT (US)

( * ) Notice: Subject to any disclaimer, the term of this patent is extended or adjusted under 35 U.S.C. 154(b) by 645 days.

(21) Appl. No.: 12/256,670

(22) Filed: Oct. 23, 2008

(65) Prior Publication Data

US 2010/0103235 A1 Apr. 29, 2010

(51) Int. Cl.
*B41J 2/01* (2006.01)

(52) U.S. Cl. ..... 347/102; 347/104

(58) Field of Classification Search ..... 347/104, 347/102

See application file for complete search history.

(56) References Cited

U.S. PATENT DOCUMENTS

| | | | | |
|---|---|---|---|---|
| 3,874,962 | A * | 4/1975 | Gersbeck et al. | 156/62.2 |
| 5,267,005 | A * | 11/1993 | Yamamoto et al. | 399/329 |
| 6,494,570 | B1 * | 12/2002 | Snyder | 347/103 |
| 6,923,533 | B2 * | 8/2005 | Pan et al. | 347/103 |
| 7,887,176 | B2 * | 2/2011 | Kovacs et al. | 347/102 |
| 2002/0158963 | A1 * | 10/2002 | Dietze | 347/238 |
| 2003/0103123 | A1 * | 6/2003 | Snyder | 347/102 |
| 2006/0077246 | A1 * | 4/2006 | Kawakami et al. | 347/104 |
| 2006/0103709 | A1 * | 5/2006 | Burdenko et al. | 347/104 |
| 2006/0290760 | A1 * | 12/2006 | German et al. | 347/102 |
| 2007/0120921 | A1 * | 5/2007 | Carlini et al. | 347/100 |
| 2007/0120930 | A1 * | 5/2007 | Domoto et al. | 347/102 |
| 2008/0122914 | A1 | 5/2008 | Toma | |
| 2010/0033545 | A1 * | 2/2010 | Caiger et al. | 347/102 |
| 2010/0212821 | A1 * | 8/2010 | Grinberg et al. | 156/247 |

FOREIGN PATENT DOCUMENTS

JP 2005-173441 * 6/2005

* cited by examiner

*Primary Examiner* — Charlie Peng
(74) *Attorney, Agent, or Firm* — Ronald E. Prass, Jr.; Prass LLP

(57) ABSTRACT

An apparatus fixes ink on a substrate, such as in ink-jet printing. A leveling member is positioned to contact an ink-bearing side of the substrate at a nip. A radiation source is positioned to direct radiation to the ink-bearing side of the substrate at the nip, the radiation suitable for curing the ink on the substrate.

18 Claims, 2 Drawing Sheets

METHOD AND APPARATUS FOR FIXING A RADIATION-CURABLE GEL-INK IMAGE ON A SUBSTRATE

CROSS-REFERENCE TO RELATED APPLICATIONS

Cross-reference is hereby made to the following U.S. Pat. applications, assigned to the assignee hereof: U.S. application Ser. No. 12/256,684, U.S. application Ser. No. 12/256,690 being filed simultaneously herewith; and U.S. application Ser. No. 11/291,284, filed Nov. 30, 2005, now US Patent Application Publication US 2007/0120930 A1.

INCORPORATION BY REFERENCE

The following documents are incorporated by reference in their entireties for the teachings therein: US Patent Application Publication US 2007/0120930 A1; and US Patent Application Publication US 2008/0122914 A1.

TECHNICAL FIELD

The present disclosure relates to printing with radiation-curable inks.

BACKGROUND

US Patent Application Publication US 2008/0122914 A1 discloses compositions for an ultraviolet (UV)-curable ink suitable for use in ink-jet printing. Such inks include one or more co-monomers and a gellant. When exposed to radiation of a predetermined frequency, these co-monomers polymerize and thus bind to any number of types of surfaces. In practical applications, such inks have a viscous property at room temperature, but become more liquid when heated for jetting onto a substrate to form images.

US Patent Application Publication US 2007/0120930 A1 discloses a printing apparatus suitable for use with a radiation-curable ink. The apparatus uses a "transfuse" system, wherein ink forming the desired image is first jetted onto an image receptor in the form of a belt, and then transferred from the image receptor onto a print sheet or other substrate. At various locations along the belt path are disposed ultraviolet radiation sources for partially hardening the ink on the belt before transferring to the print sheet.

Although the above-described apparatus uses an image receptor to apply ink to a print sheet, it would be desirable to provide a system where such an ink as above described could be applied directly to a print sheet or other substrate. One challenge to such a system is that, in practical applications, such inks tend to have a "mayonnaise" consistency at room temperature, but when heated incidental to jetting, change to a low viscosity liquid. A typical ink-jet printing process heats the ink until it is liquid and then directly fires ink droplets from a piezoelectric print head onto the substrate. Once the ejected ink hits the substrate, it changes phase from the liquid back to its more viscous consistency, thereby reducing its penetration into porous media. Once this ink is exposed to UV radiation, photoinitiators in the ink are bombarded with UV radiation and the incident flux converts the monomers present in the ink into a cross linked polymer matrix resulting in a very hard and durable mark on the paper.

However, there is a desire to have the ink leveled prior to having it UV cured. The reason for this is so that gloss is more uniform, missing jets can be masked, and certain applications such as packaging require thin layers of relatively constant thickness. Since these inks have a mayonnaise consistency, they have very little cohesive strength prior to curing. In addition, the inks are typically designed to have good affinity to many materials. This means that conventional methods for flattening a layer of ink tend to fail, because the ink splits and leaves much of the image behind on the device trying to flatten it, such as a traditional fuser roll as familiar in xerography. The present description proposes a way to resolve this issue.

SUMMARY

According to one aspect, there is provided an apparatus for fixing ink on a substrate. A leveling member is positioned to contact an ink-bearing side of the substrate at a nip. A first radiation source is positioned to direct radiation to the ink-bearing side of the substrate at the nip, the radiation suitable for curing the ink on the substrate.

DETAILED DESCRIPTION

Figure 1:
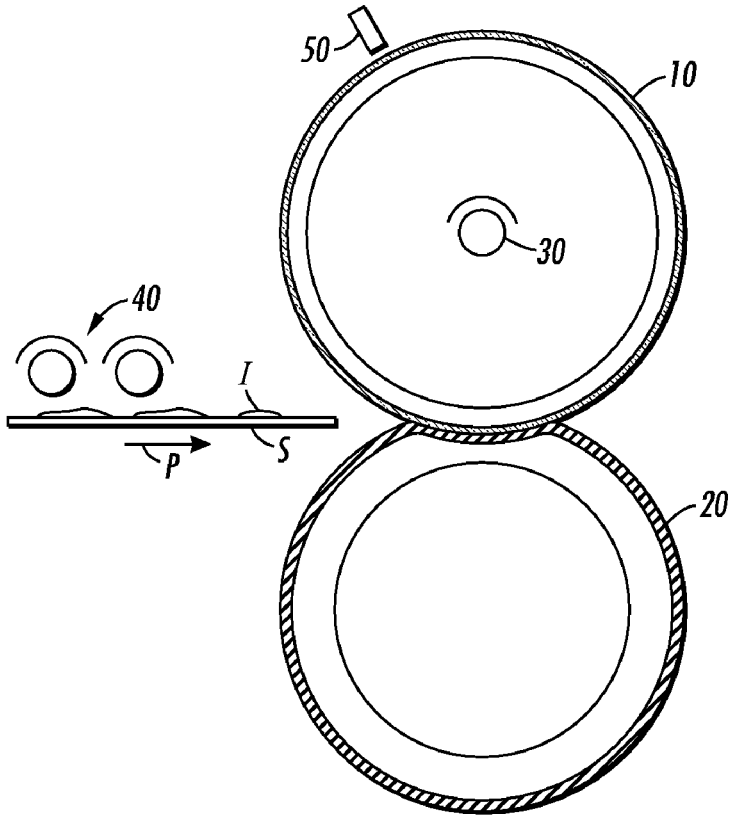
FIG. 1 is a simplified elevational view of a fixing apparatus, as would be found in a larger printing apparatus, according to a first embodiment.

FIG. 1 is a simplified elevational view of a fixing apparatus, as would be found in a larger printing apparatus, according to a first embodiment. A sheet or substrate (of any suitable material) S bearing an unfixed ink image I approaches, along a process direction P, a fixing apparatus including a rotatable member, here in the form of an ink-side leveling roller 10, and a backing member here in the form of a backing roller 20. In a practical embodiment, the ink image I comprises at this time an uncured, viscous liquid that has not significantly penetrated into the substrate S. At the nip formed between rollers 10 and 20, the unfixed ink I is mechanically "leveled" by the nip pressure, which effectively causes the various layers of multi-colored inks to assume a consistent total height relative to the surface I of substrate S.

Simultaneous with the mechanical pressure applied at the nip, radiant energy is applied to the ink I, the radiant energy including suitable wavelengths, typically UV, for chemical curing of the ink I on substrate S as any small area of substrate S passes through the nip. For this purpose there is disposed within leveling roller 10 a radiation source 30, which may include for this embodiment one or more UV lamps or a UV-emitting LED array, directing radiation to the ink I in the nip as the substrate S moves therethrough. The power of source 30 or multiple sources is such that the ink I is fully cured by the time it leaves the nip for a given process speed.

In such an embodiment, the walls of leveling roller 10 are effectively transmissive of the curing radiation, so the radiation can efficiently reach the ink I in the nip. According to possible embodiments, leveling roller 10 is comprised of a quartz core with a shrink fit release layer surface. The outer layer of leveling roller 10 is a low surface energy material that also passes UV radiation such as clear PTFE, but other alternatives, such as fluorocarbons, are available. The backing roller 20 is typically formed of silicone over metal.

Also shown in FIG. 1 are IR lamps 40, or equivalents, for pre-heating a substrate S as needed given a particular material set (ink and substrate). A temperature sensor 50 of known type can measure the surface temperature of leveling roller 10 just upstream of the nip, the recorded temperature being useful for a control system.

The curing of ink I is simultaneous with the mechanical pressure formed at the nip so that sufficient cross linking of monomer chains in the ink is initiated while still under a leveling condition such that polymerization is substantially complete by the time the image I leaves the nip formed by rollers 10 and 20. The process of polymerization results in a solid durable material that experiences some shrinkage. The shrinkage and hardness combined with the low surface energy layer on roller 10 lead to a condition whereby the image tends to self strip from the roller 10.

Figure 2:
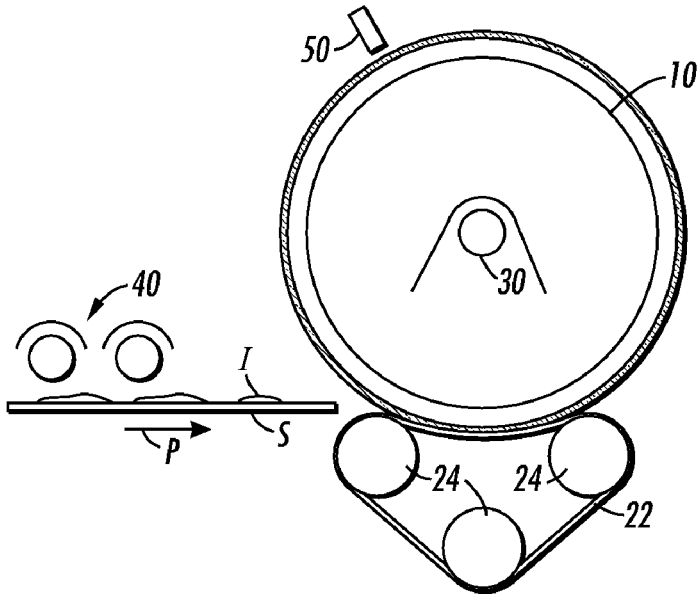
FIG. 2 is a simplified elevational view of a fixing apparatus according to a second embodiment.

FIG. 2 is a simplified elevational view of a fixing apparatus, as would be found in a larger printing apparatus, according to a second embodiment. Like reference numbers from FIG. 1 indicate analogous elements in FIG. 2. The FIG. 2 embodiment differs from FIG. 1 in that, in lieu of the backing roller, there is provided a rotatable backing belt 22, which forms a nip along a significant wrap angle around the leveling roller 10. The belt 22 can be entrained around any number of inner rollers 24 to provide a necessary nip pressure against leveling roller 10. The backing belt 22 provides a significantly longer dwell time for ink under mechanical pressure to be cured by radiation source 30. One basic composition of backing belt 22 includes polyimide with a silicone overcoat.

Figure 3:
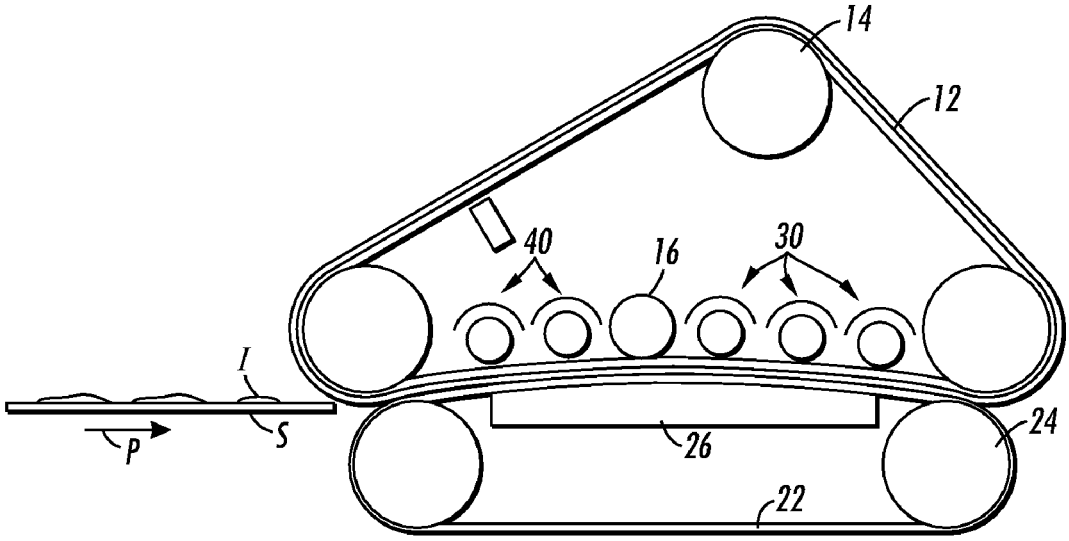
FIG. 3 is a simplified elevational view of a fixing apparatus according to a third embodiment.

FIG. 3 is a simplified elevational view of a fixing apparatus, as would be found in a larger printing apparatus, according to a third embodiment. Like reference numbers from FIG. 1 or FIG. 2 indicate analogous elements in FIG. 3. In this embodiment, in lieu of a leveling roller, there is provided a leveling belt 12, entrained on any number of inner rollers 14, forming a nip against backing belt 22. An adjustable pressure roller 16 disposed within leveling belt 22 can urge a portion of the belt, along a point in the nip, against backing belt 22, which can be supported with a pressure pad 26, as shown.

The leveling belt 12 includes multiple layers. An inner layer provides a durable surface that serves as support and a drive surface. One suitable material is a clear (to UV) polyimide. The outer layer of leveling belt 12 includes a low surface energy material that also passes UV radiation; one suitable material is clear PTFE, but other alternatives, such as fluorocarbons, are possible. The adhesive between the layers must also be effectively transmissive of UV.

The nip pressure is held constant through the length of the nip by the slightly curved pressure pad 26 inside the backing belt 22 that applies force normal to the backing belt 22, thereby pushing it into the leveling belt 12, and causing substrates S passing therethrough to be bent outward with respect to the uncured ink I thereon. The outward bending aids in the self-stripping of the ink.

Further as can be seen in FIG. 3, IR lamps 40 as described above are disposed within leveling belt 12 at an early part of the nip along the process direction P. These lamps, or equivalents, are used to bring the ink I and substrate S to a predetermined temperature prior to curing, as needed. Following the adjustable pressure roller 16, the UV sources 30 cure the ink I onto substrate S.

Although the two radiation sources in the illustrated embodiment provide first IR for heating and then UV for curing, different applications may require different arrangements of radiation sources. For example, if a plurality of inks is placed on substrate S, such as for different primary colors or other attributes such as magnetic properties, it may be desired to cure one ink (having one particular curing wavelength) before the other (having another particular curing wavelength). The radiation sources can be arranged to effect this ordered curing. Alternatively, multiple radiation sources may differ in other aspects, such as amplitude, to obtain desired print properties, such as gloss, given a particular material set.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. An apparatus for fixing radiation curable gel ink on a substrate, the substrate being a recording medium, comprising:

a leveling member, positioned to contact a radiation curable gel ink-bearing side of the recording medium at a nip; and a first radiation source, positioned to direct radiation to the ink-bearing side of the recording medium at the nip, the radiation suitable for curing the ink on the recording medium, the radiation curable gel ink being deposited directly onto the recording medium from a print head.

2. The apparatus of claim 1, the leveling member being rotatable, the first radiation source being substantially disposed within the rotatable leveling member, the first rotatable member being effectively transmissive of radiation.

3. The apparatus of claim 1, the first radiation source directing UV radiation.

4. The apparatus of claim 1, further comprising a second radiation source, the second radiation source directing radiation to the recording medium before the first radiation source.

5. The apparatus of claim 4, the first radiation source directing radiation of a first type and the second radiation source directing radiation of a second type.

6. The apparatus of claim 5, the first radiation source substantially directing UV radiation and the second radiation source substantially directing IR radiation.

7. The apparatus of claim 4, the leveling member being rotatable, the second radiation source being substantially disposed within the rotatable leveling member.

8. The apparatus of claim 7, further comprising a pressure roller disposed between the first radiation source and the second radiation source along a process direction.

9. The apparatus of claim 1, the leveling member including a roller.

10. The apparatus of claim 9, the roller including a quartz core.

11. The apparatus of claim 9, the roller including an outer layer of a low surface energy material.

12. The apparatus of claim 1, the leveling member including a belt.

13. The apparatus of claim 12, the belt including an outer layer of a low surface energy material.

14. The apparatus of claim 1, further comprising a backing member, positioned to contact the recording medium at the nip, opposite the radiation curable gel ink-bearing side of the recording medium.

15. The apparatus of claim 14, the backing member including a roll.

16. The apparatus of claim 14, the backing member including a belt.

17. The apparatus of claim 16, the belt including polyimide with a substantially silicone overcoat.

18. The apparatus of claim 14, further comprising a pressure plate disposed within the backing belt, the pressure plate causing a recording medium passing through the nip to be bent outward with respect to the ink thereon.

* * * * *